US010221584B2

(12) United States Patent
Hui et al.

(10) Patent No.: US 10,221,584 B2
(45) Date of Patent: Mar. 5, 2019

(54) SWIMMING POOL CLEANING WITH WALL CLIMBING CAPABILITY AND METHOD THEREFOR

(71) Applicants: Wing-Tak Hui, Hong Kong (CN); Andrew Matthew Hui, San Jose, CA (US); Martin Wing-Kin Hui, Hong Kong (CN)

(72) Inventors: Wing-Tak Hui, Hong Kong (CN); Andrew Matthew Hui, San Jose, CA (US); Martin Wing-Kin Hui, Hong Kong (CN)

(73) Assignee: COMPUROBOT TECHNOLOGY COMPANY, Dongguan (CN)

( * ) Notice: Subject to any disclaimer, the term of this patent is extended or adjusted under 35 U.S.C. 154(b) by 239 days.

(21) Appl. No.: 14/875,349

(22) Filed: Oct. 5, 2015

(65) Prior Publication Data

US 2017/0096826 A1 Apr. 6, 2017

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
USPC ..... 15/1.7
See application file for complete search history.

(56) References Cited

U.S. PATENT DOCUMENTS 9,399,877 B2 * 7/2016 Erlich ..... E04H 4/1654
2016/0145884 A1 5/2016 Erlich et al.

FOREIGN PATENT DOCUMENTS

CN 201358597 Y * 12/2009 ..... E04H 4/1654

OTHER PUBLICATIONS

English translation of CN 201358597 Y, dated Dec. 2009, Fu.*

* cited by examiner

*Primary Examiner* — Laura C Guidotti
(74) *Attorney, Agent, or Firm* — Weiss & Moy, P.C.; Jeffrey D. Moy

(57) ABSTRACT

An automated swimming pool cleaner has a housing having an inlet formed on a bottom surface thereof. A drive mechanism is located within the housing. A first rolling mechanism is coupled to a bottom section of the housing. A second rolling mechanism is coupled to the bottom section of the housing. A third rolling mechanism is coupled to the bottom section of the housing between the first rolling mechanism and the second rolling mechanism. The third rolling mechanism extends lower from the housing than the first rolling mechanism and the second rolling mechanism allowing the automated swimming pool cleaner to pivot about the third rolling mechanism. The drive mechanism rotates at least one of the first rolling mechanism, the second rolling mechanism, or the third rolling mechanism.

8 Claims, 26 Drawing Sheets

SWIMMING POOL CLEANING WITH WALL CLIMBING CAPABILITY AND METHOD THEREFOR

TECHNICAL FIELD

The present application generally relates to a cleaning device for a swimming pool, and more specifically, to a swimming pool cleaning device that has the ability to climb side walls when the transition between the swimming pool floor and the side is sharp.

BACKGROUND

Automated swimming pool cleaning devices (hereinafter pool cleaners) are used for maintaining residential and commercial swimming pools in a clean and attractive condition. Pool cleaners have been developed for cleaning and/or dislodging settled debris from the floor and side wall surfaces of the swimming pool, thereby substantially reducing the need for manual vacuuming and/or brushing of the floor and side wall surfaces of the swimming pool.

A typical pool cleaner may include a housing and a drive member. The drive member may attach to the housing usually through a connection to a chassis. The drive member may include wheels, endless loop tracks and combinations thereof each. In the case of a belt or endless loop track, the track may wrap around the drive and/or idler wheels or rollers. The housing is generally coupled to a swimming pool water filtration system by a hose. The swimming pool water filtration system may power the drive members causing the pool cleaning device to travel about within the swimming pool to dislodge and collect settled debris.

Swimming pool surface may be made of rough pebble or smooth tiles. The transition between the swimming pool floor and wall could be a generous radius or a sharp angle with no transition. Without any assistance, pool cleaners can climb only at a swimming pool surface whose coefficient of friction is greater than 1. That is extremely hard to achieve especially in a wet environment where there is little to no transition between the swimming pool floor and wall.

Therefore, it would be desirable to provide a system and method that overcomes the above.

SUMMARY

In accordance with one embodiment, an automated swimming pool cleaner is disclosed. The automated swimming pool cleaner has a housing having an inlet formed on a bottom surface thereof. A drive mechanism is located within the housing. A first rolling mechanism is coupled to a bottom section of the housing. A second rolling mechanism is coupled to the bottom section of the housing. A third rolling mechanism is coupled to the bottom section of the housing between the first rolling mechanism and the second rolling mechanism. The third rolling mechanism extends lower from the housing than the first rolling mechanism and the second rolling mechanism allowing the automated swimming pool cleaner to pivot about the third rolling mechanism. The drive mechanism rotates at least one of the first rolling mechanism, the second rolling mechanism, or the third rolling mechanism.

In accordance with one embodiment, an automated swimming pool cleaner is disclosed. The automated swimming pool cleaner has a housing. A pump is located within the housing. An inlet is formed on a bottom surface of the housing for sucking up of dirt and debris into the housing through a vacuum created by the pump. A first rolling mechanism is coupled to a bottom front section of the housing. A second rolling mechanism is coupled to a bottom rear section of the housing. A third rolling mechanism is coupled to a bottom section of the housing between the first rolling mechanism and the second rolling mechanism. The third rolling mechanism extends lower from the housing than the first rolling mechanism and the second rolling mechanism to allow the automated swimming pool cleaner to pivot about the third rolling mechanism. A drive mechanism is located within the housing rotating at least one of the first rolling mechanism, the second rolling mechanism, or the third rolling mechanism.

In accordance with one embodiment, an automated swimming pool cleaner is disclosed. The automated swimming pool cleaner has a housing. A pump is located within the housing. An inlet is formed on a bottom surface of the housing for sucking up of dirt and debris into the housing through a vacuum created by the pump. A first rolling mechanism is coupled to a bottom section of the housing. A second rolling mechanism is coupled to the bottom section of the housing, wherein the first rolling mechanism and the second rolling mechanism are located on a first plane level on the bottom section of the housing. A third rolling mechanism is coupled to the bottom middle section of the housing. The third rolling mechanism is located on a second plane level on the bottom section of the housing. The second plane level is lower on the housing than the first plane level to allow the automated swimming pool cleaner to pivot about the third rolling mechanism.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
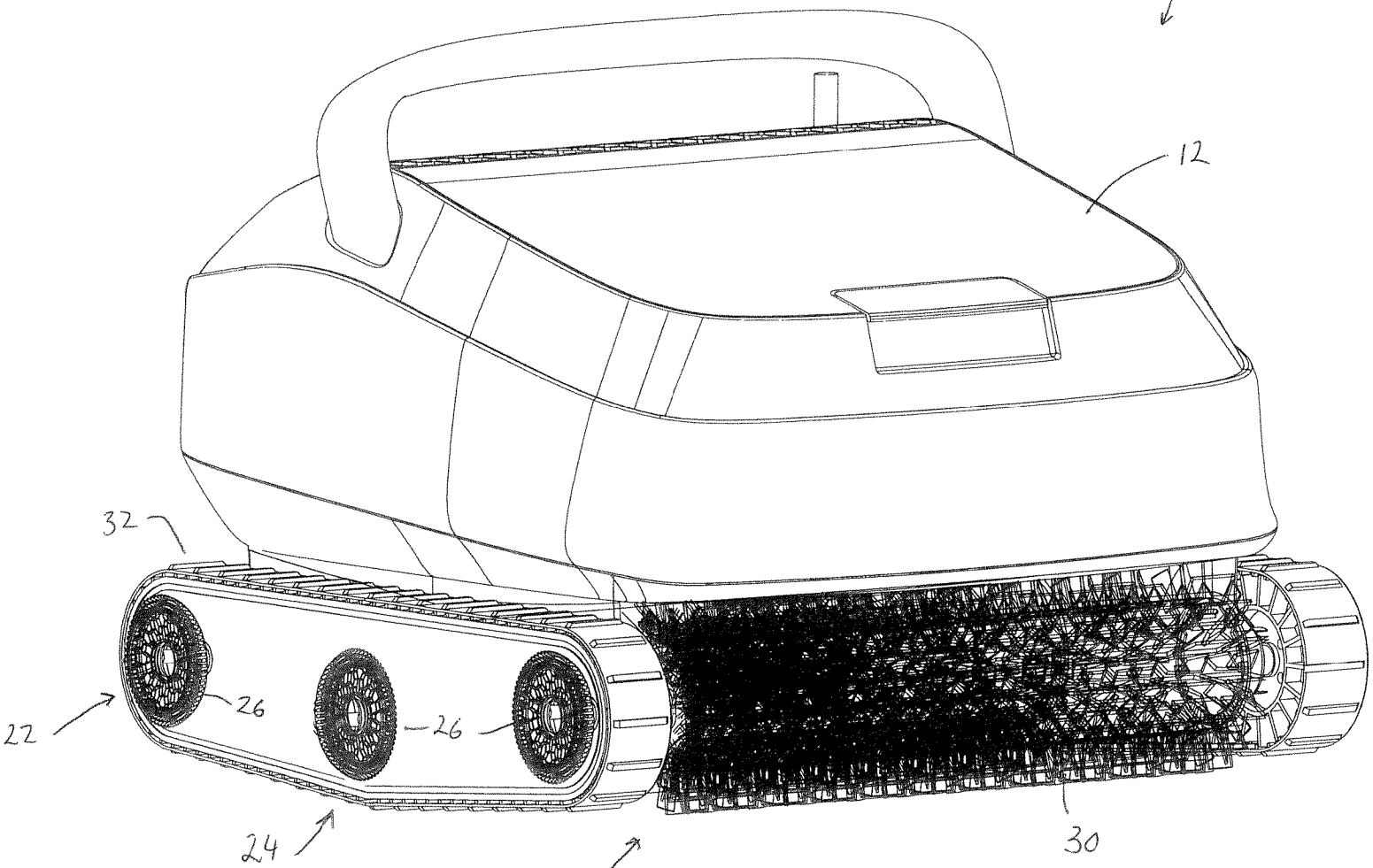
FIG. 1 is a front prospective view of a swimming pool cleaning device with enhanced climbing capabilities in accordance with one aspect of the present application.
Figure 2:
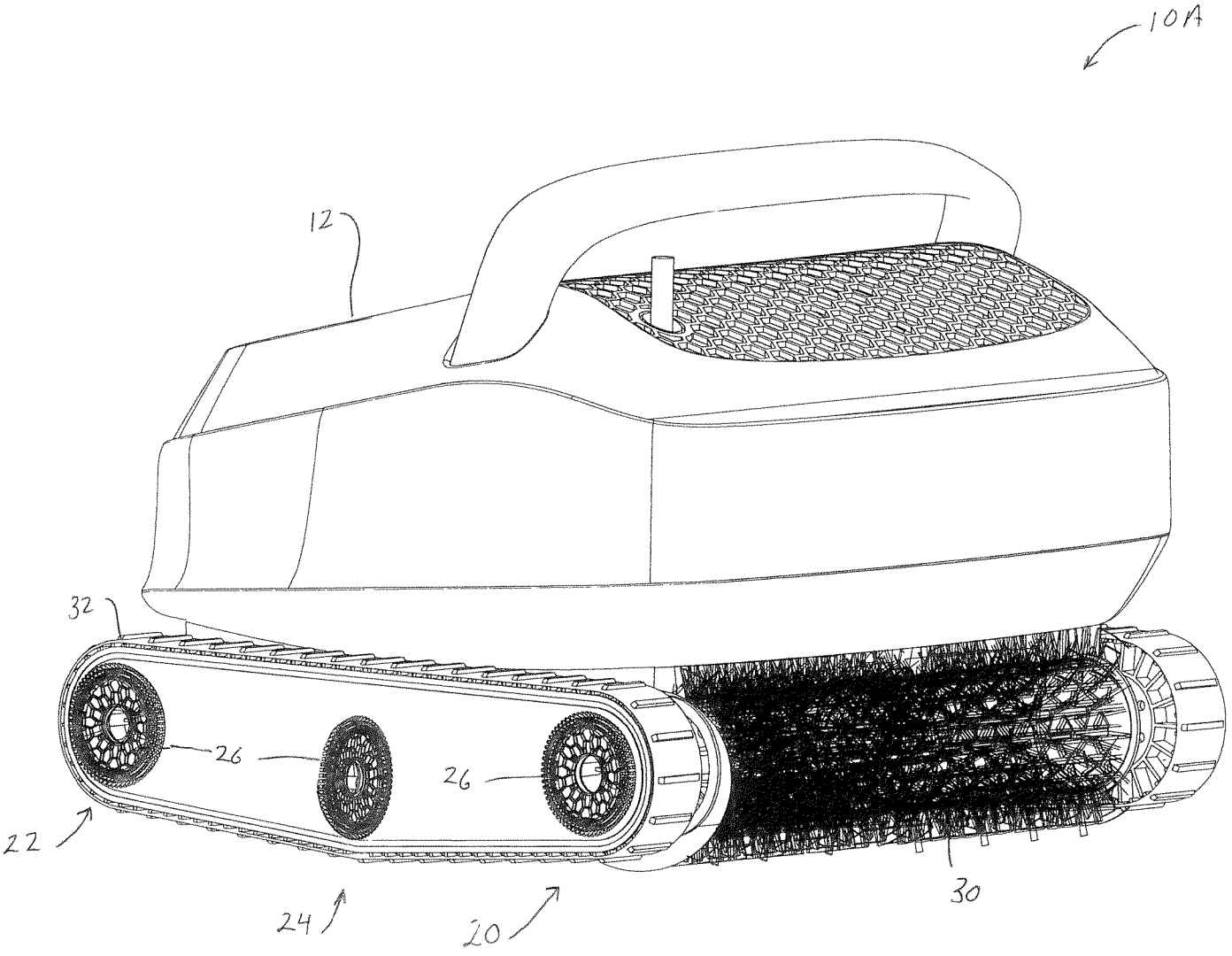
FIG. 2 is a is a rear prospective view of the swimming pool cleaning device of FIG. 1 in accordance with one aspect of the present application.
Figure 3:
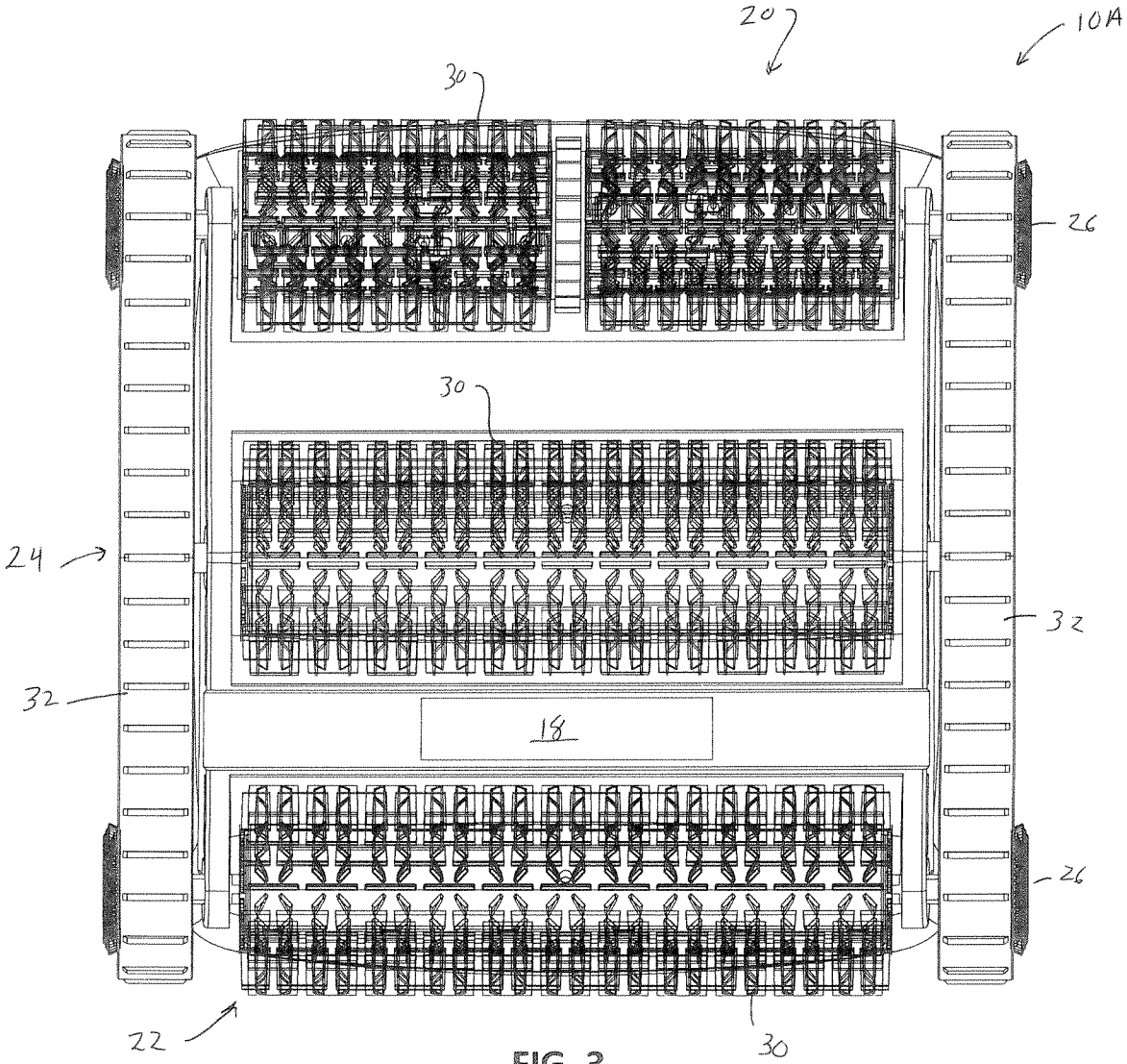
FIG. 3 is a bottom view of the swimming pool cleaning device of FIG. 1 in accordance with one aspect of the present application.
Figure 4:
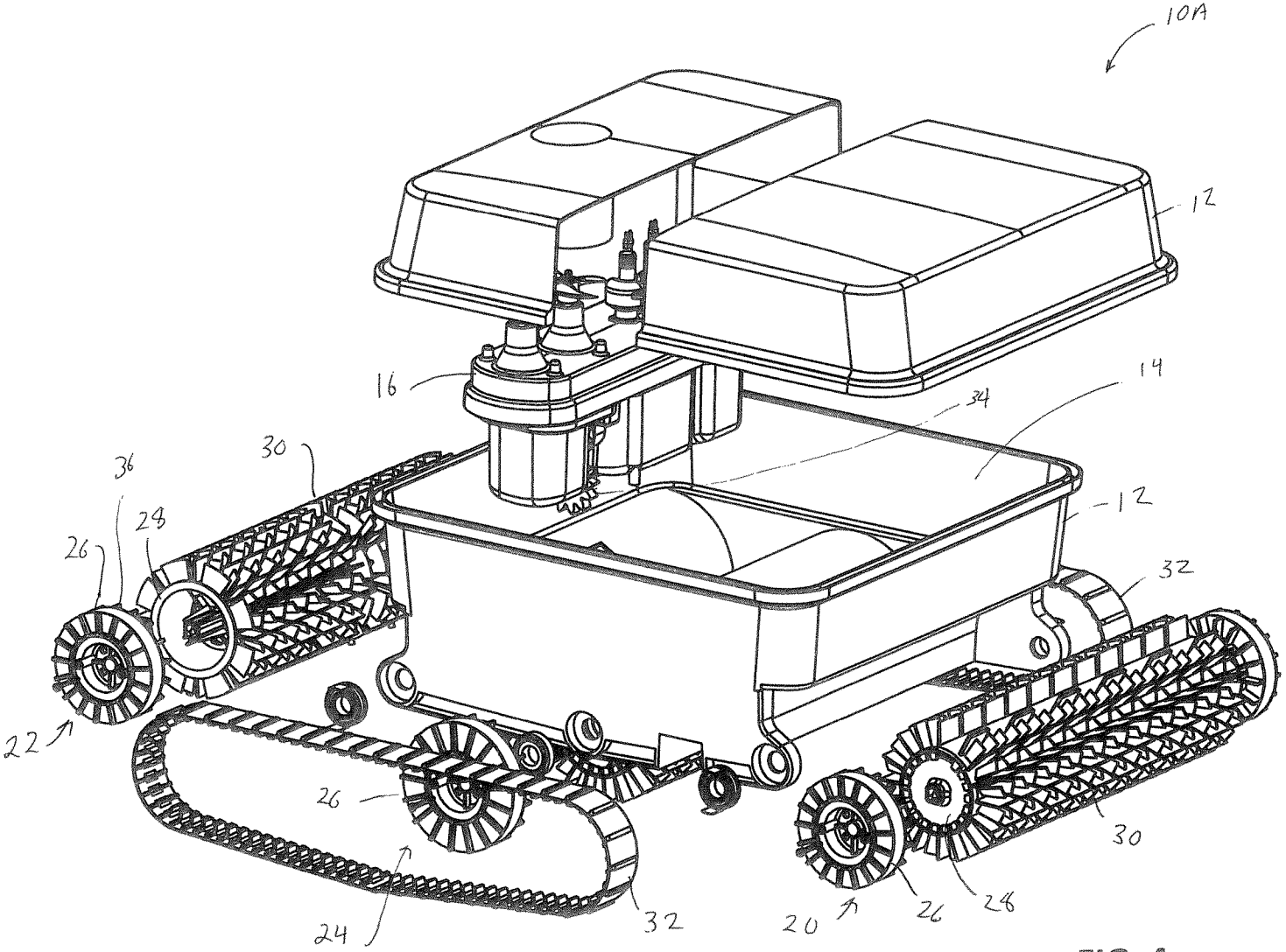
FIG. 4 is an exploded view of the swimming pool cleaning device of FIG. 1 in accordance with one aspect of the present application.
Figure 5:
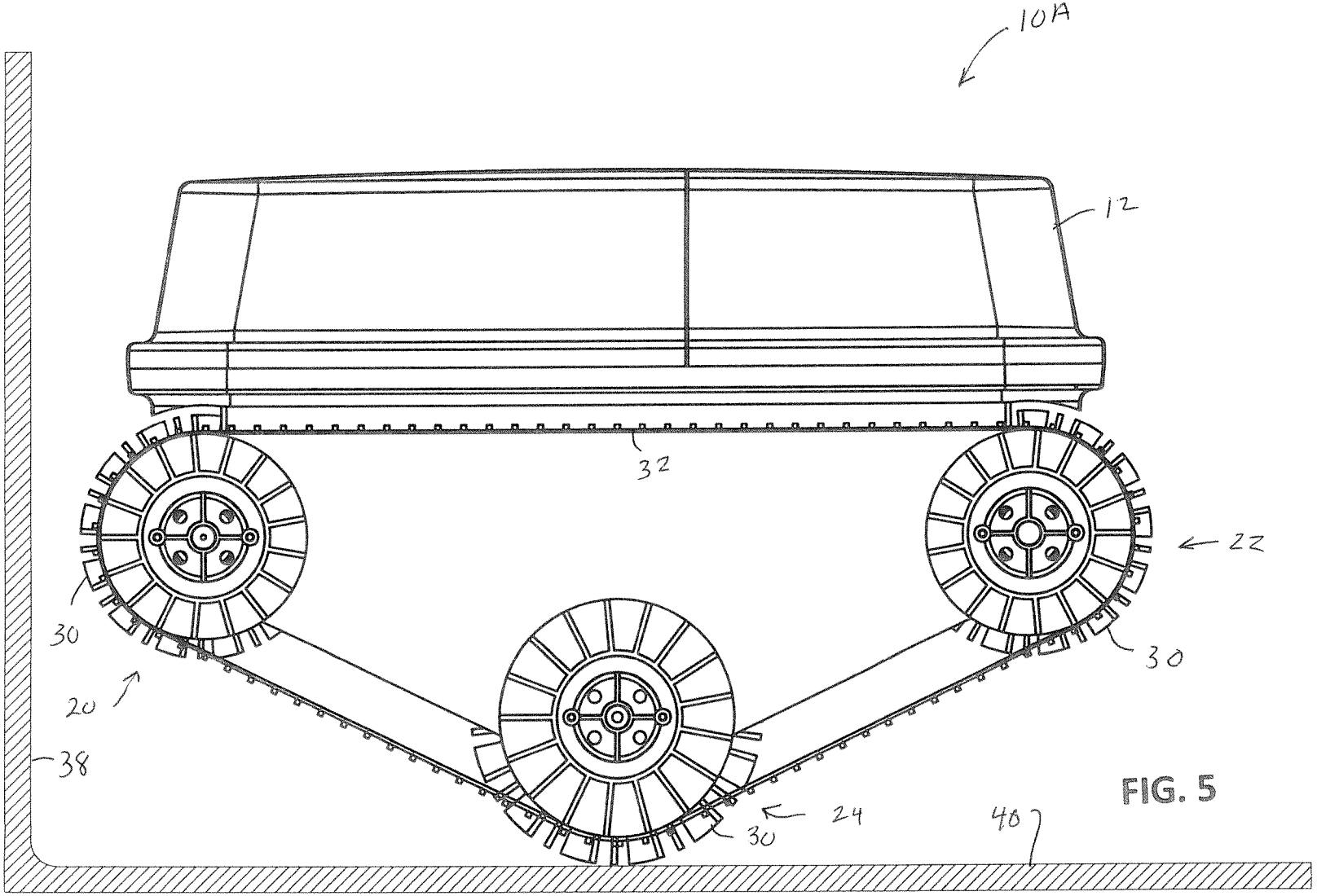
FIG. 5 is a side view of the swimming pool cleaning device of FIG. 1 approaching a side wall of a swimming pool in accordance with one aspect of the present application.
Figure 6:
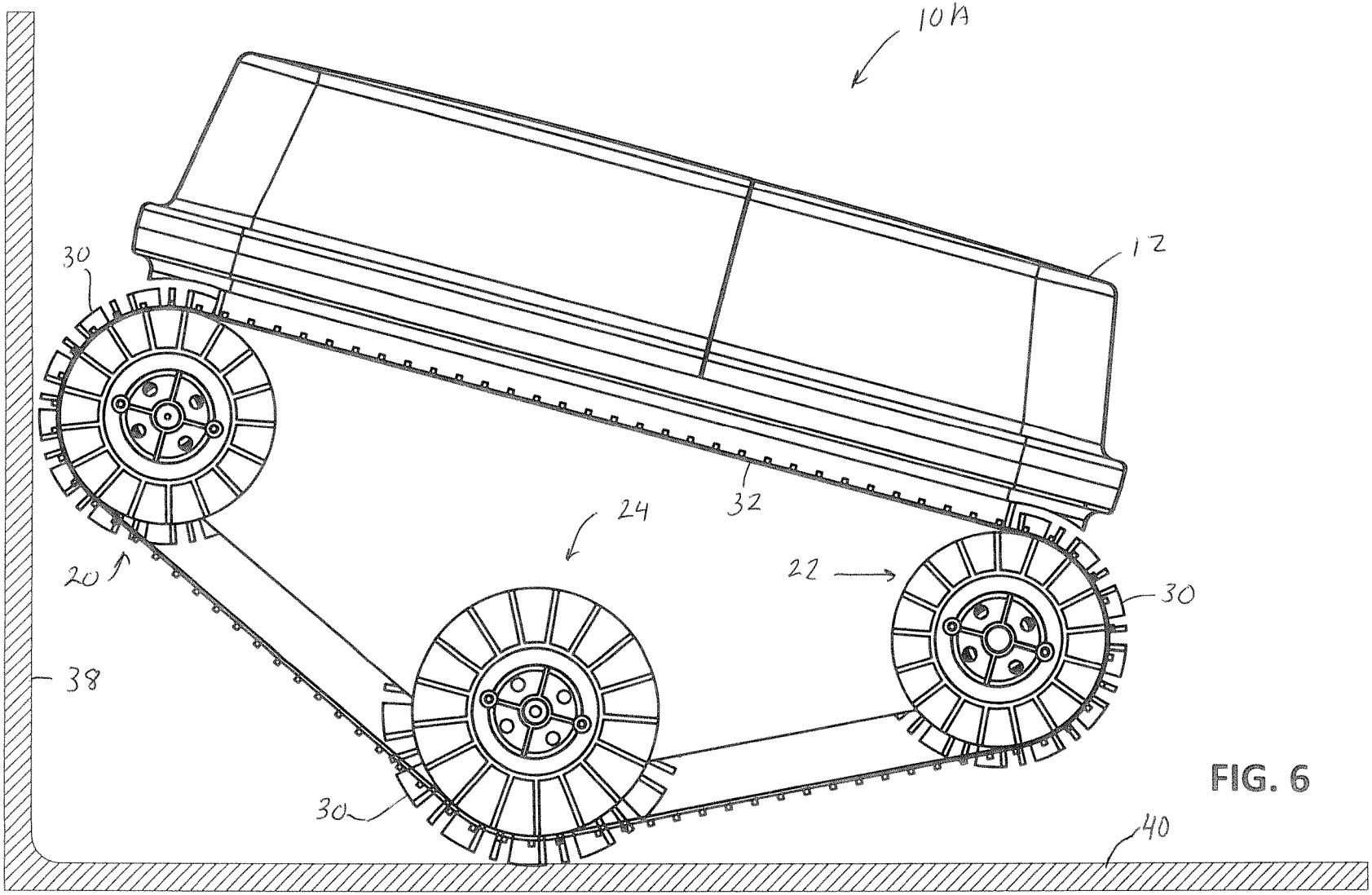
FIG. 6 is a side view of the swimming pool cleaning device of FIG. 1 engaging the side wall of a swimming pool in accordance with one aspect of the present application.
Figure 7:
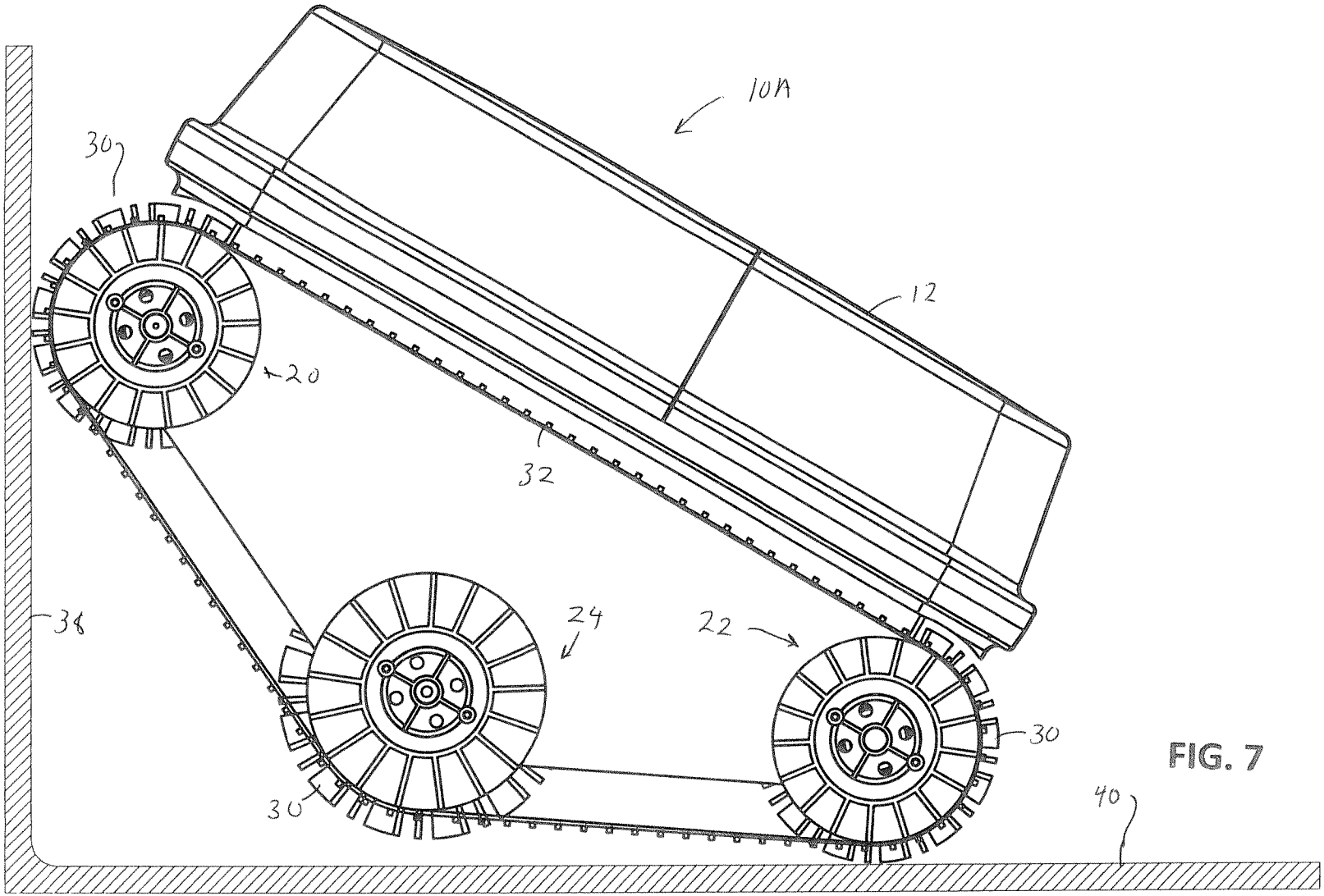
FIG. 7 is a side view of the swimming pool cleaning device of FIG. 1 climbing the side wall of a swimming pool in accordance with one aspect of the present application.
Figure 8:
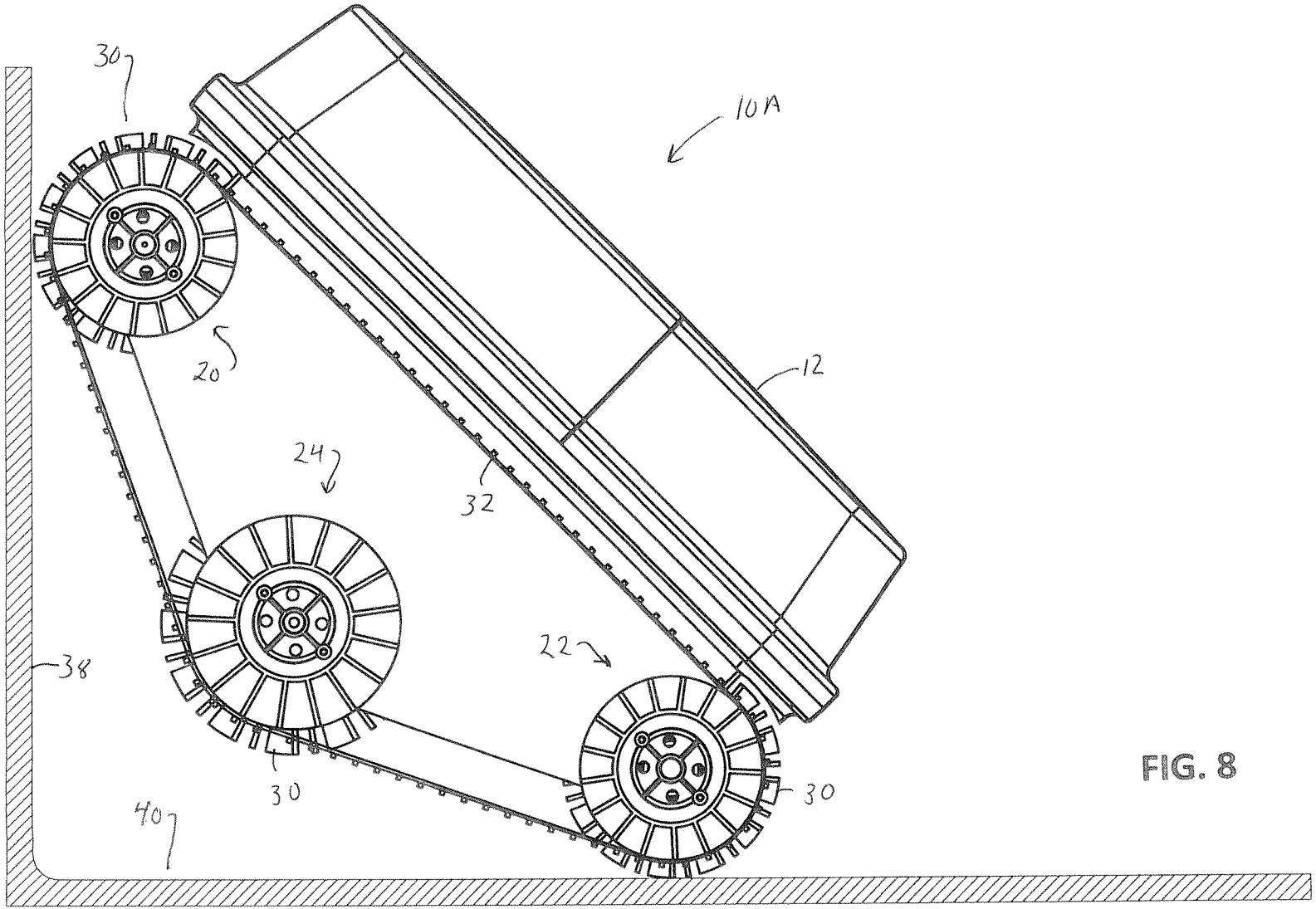
FIG. 8 is a side view of the swimming pool cleaning device of FIG. 1 climbing the side wall of a swimming pool in accordance with one aspect of the present application.
Figure 9:
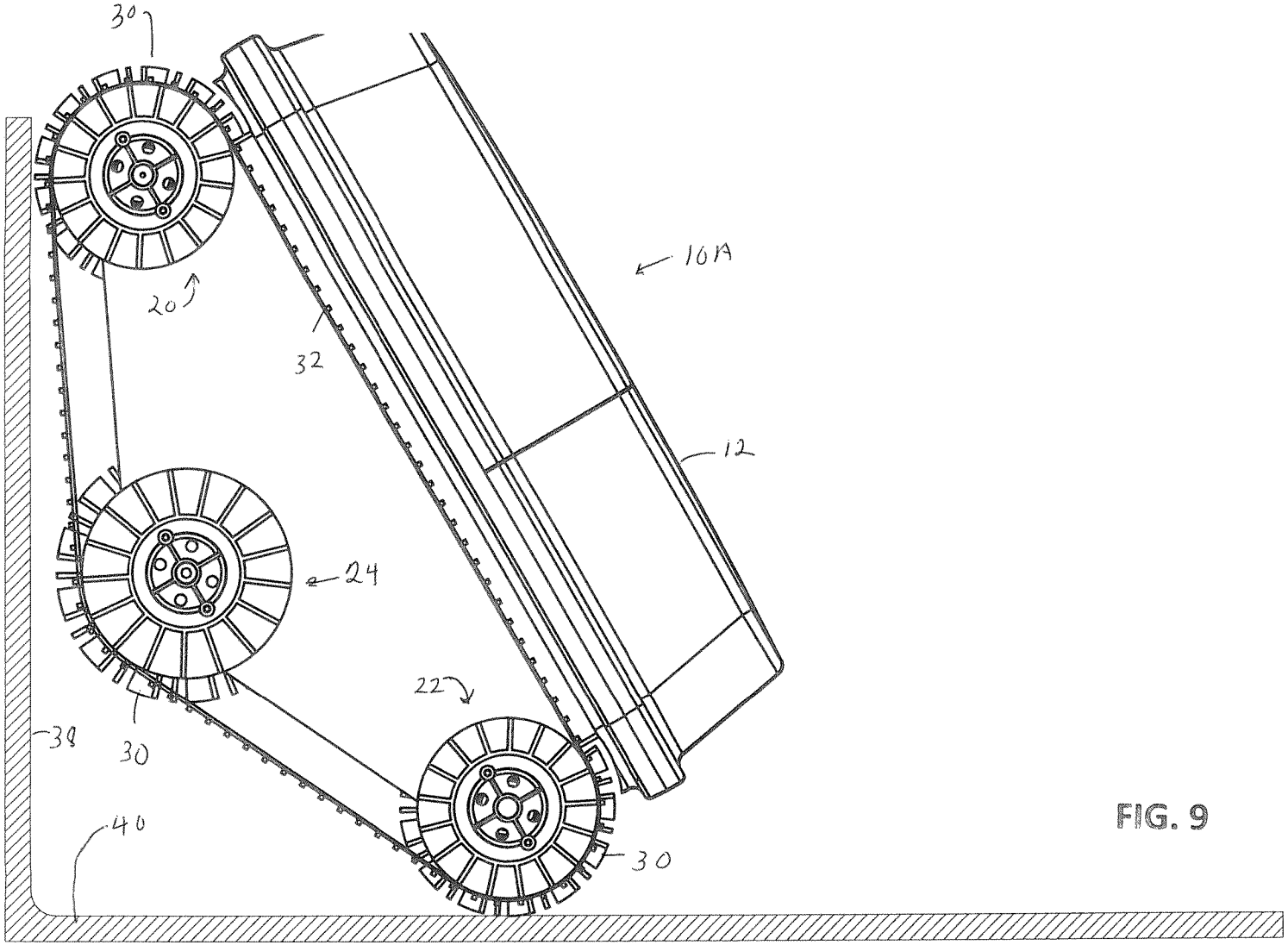
FIG. 9 is a side view of the swimming pool cleaning device of FIG. 1 climbing the side wall of a swimming pool in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure Embodiments of the exemplary system and method provide an automated swimming pool cleaner (hereinafter pool cleaner) that has enhanced wall climbing capabilities. The pool cleaner may climb a side wall of the swimming pool whether a transition between the swimming pool floor and wall is at a generous radius or at a sharp angle with little to no transition. The pool cleaner has at least one rotating element positioned between a front wheel set and a rear wheel set which may allow the pool cleaner to rock. The rocking ability may allow the pool cleaner to lift up a front section of the pool cleaner when the front section hits the side wall. This may allow the pool cleaner to obtain better traction in order to climb the side wall of the swimming pool.

Referring to FIGS. 1-4, an automated swimming pool cleaner 10A (hereinafter pool cleaner 10A) is shown. The pool cleaner 10A has a housing 12. Located within an interior 14 of the housing 12 is a pump 16. The pump 16 may be used to create a vacuum. When the pump 16 is active, the pump 16 creates a vacuum that causes dirt and debris to be sucked into the housing 12 through one or more an intakes 18.

The pool cleaner 10A may have a first rolling mechanism 20 located in a bottom area of a front section of the housing 12. A second rolling mechanism 22 may be located in a bottom area of a rear section of the housing 12. A third rolling mechanism 24 may be located in the bottom area of the housing 12 between the first rolling mechanism 20 and the second rolling mechanism 22. While FIGS. 1-4, show the third rolling mechanism 24 to be in the middle of the bottom area of the housing 12, the third rolling mechanism 24 may be positioned anywhere between the first rolling mechanism 20 and the second rolling mechanism 22. The pool cleaner 10A is able to pivot about the third rolling mechanism 24. This may allow the pool cleaner 10A to lift up and raise the front section of the pool cleaner 10A when the front section hits the side wall of the swimming pool. In accordance with one embodiment, the third rolling mechanism 24 is positioned lower on the bottom section of the housing 12 thereby allowing the pool cleaner 10A to pivot about the third rolling mechanism 24 in order to lift up and raise the front section of the pool cleaner 10A when the front section hits the side wall of the swimming pool.

The first rolling mechanism 20, second rolling mechanism 22 and third rolling mechanism 24 may each be formed of a pair of wheels 26, a roller 28, a combination of the pair of wheels 26 and the roller 28 or similar rolling devices. Brushing elements 30 may extend from an exterior surface of the roller 28. The brushing elements 30 may be used to stir up and encouraging dirt and debris to enter intakes 18 in the housing 12. A track 32 may be positioned around opposing ends of portions of the first rolling mechanism 20, second rolling mechanism 22 and third rolling mechanism 24. The track 32 may be used to increase the traction of the pool cleaner 10A.

The pump 16 may be used to power a drive system 34. The drive system 34 may be used to rotate one or more of the first rolling mechanism 20, second rolling mechanism 22 and/or third rolling mechanism 24. The drive system 34 may engage and rotate a gear 36 foamed on the first rolling mechanism 20, second rolling mechanism 22 and/or third rolling mechanism 24 causing the first rolling mechanism 20, second rolling mechanism 22 and/or third rolling mechanism 24 to rotate and moving the pool cleaner 10A.

Referring now to FIGS. 5-9, as may be seen in these figures, the third rolling mechanism 24 protrudes further down allowing the pool cleaner 10A to pivot about the third rolling mechanism 24. In accordance with one embodiment, the third rolling mechanism 24 may be positioned lower on the bottom section of the housing 12 than the first rolling mechanism 20 and second rolling mechanism 22 thereby allowing the pool cleaner 10A to pivot about the third rolling mechanism 24. In this embodiment, the first rolling mechanism 20 and second rolling mechanism 22 may be attached to the bottom area of the housing 12 on a first plane level. The third rolling mechanism 24 may be attached to the bottom section of the housing 12 at a second plane level wherein the second plane level would be at a lower level than the first plane level. This may allow the third rolling mechanism 24 to protrude further down from the housing 12 allowing the pool cleaner 10 to pivot about the third rolling mechanism 24.

As shown in FIGS. 5-9, the pool cleaner 10A may move about the floor 42 of the swimming pool. The pool cleaner 10A may balance about the third rolling mechanism 24. When the front section of the pool cleaner 10A engages the side wall 38, the pool cleaner 10A pivots about the third rolling mechanism 24, lifting up and raising the front section of the pool cleaner 10A. This may allow the first rolling mechanism 20 to engage the side wall 38 while the second rolling mechanism 22 engages the floor 40 enhancing the climbing ability of the pool cleaner 10A.

Figure 10:
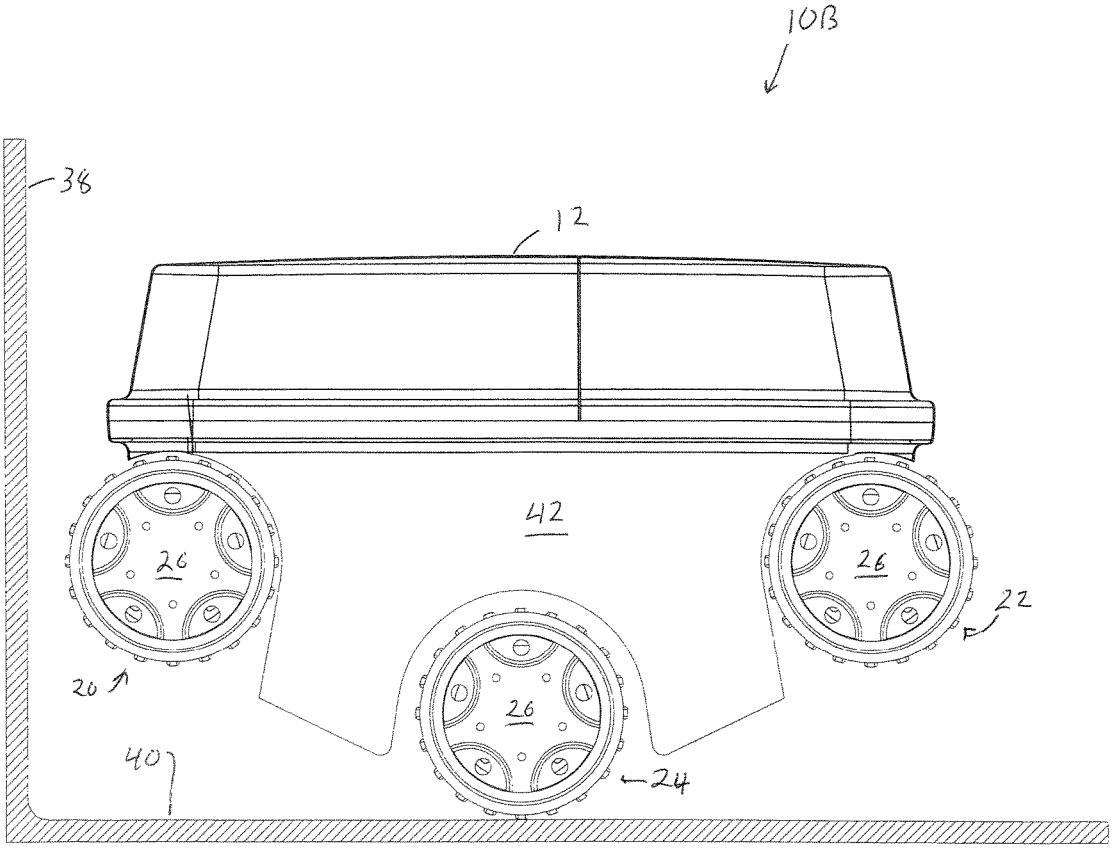
FIG. 10 is a side view of a swimming pool cleaning device approaching the side wall of a swimming pool in accordance with one aspect of the present application.
Figure 11:
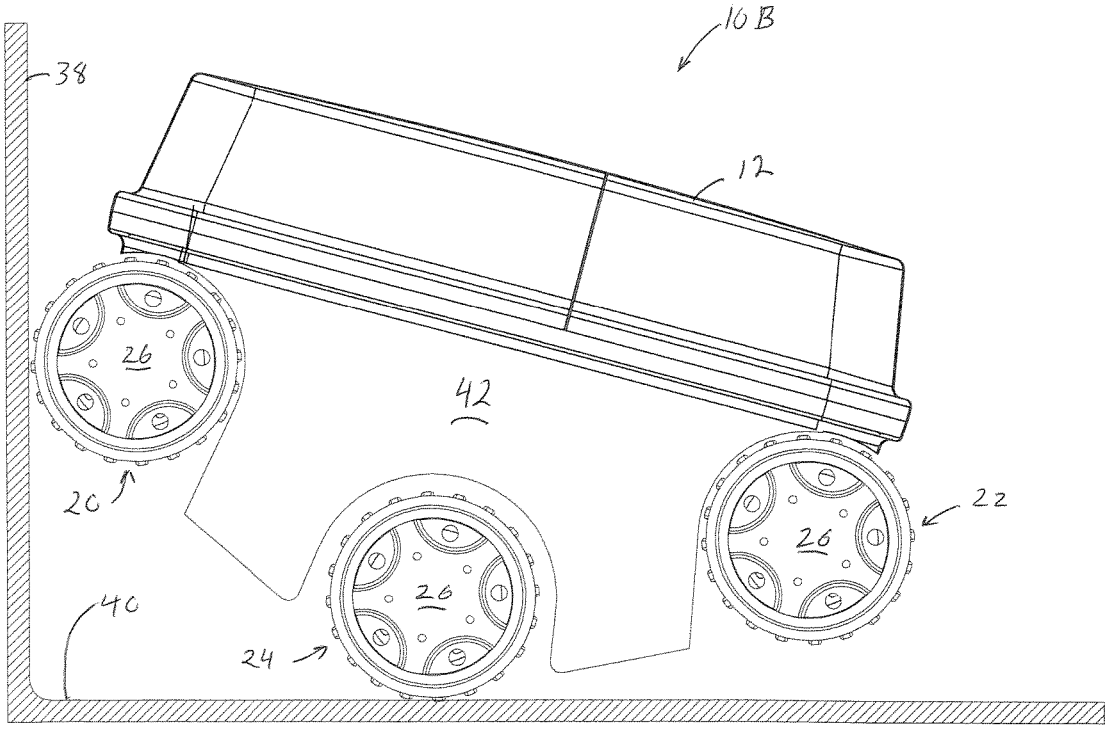
FIG. 11 is a side view of the swimming pool cleaning device of FIG. 10 engaging the side wall of a swimming pool in accordance with one aspect of the present application.
Figure 12:
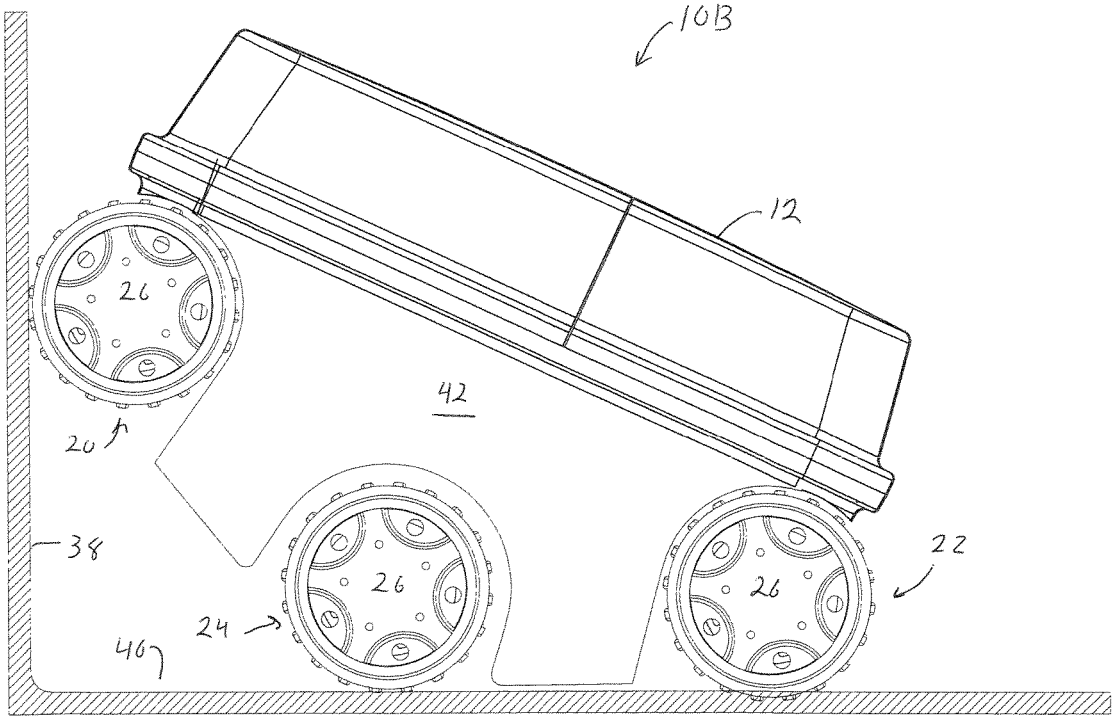
FIG. 12 is a side view of a swimming pool cleaning device of FIG. 10 climbing the side wall of a swimming pool in accordance with one aspect of the present application.

Referring to FIGS. 10-12, another embodiment of the pool cleaner 10B may be shown. The pool cleaner 10B has a plate member 42 extending down from the housing 12. The plate member 42 may be used to protect the first, second and third rolling mechanisms 20, 22 and 24 respectively, as well as to provide stability by preventing the pool cleaner 10B from tipping over when engaging the side wall 38 as shown in FIG. 12.

Figure 13:
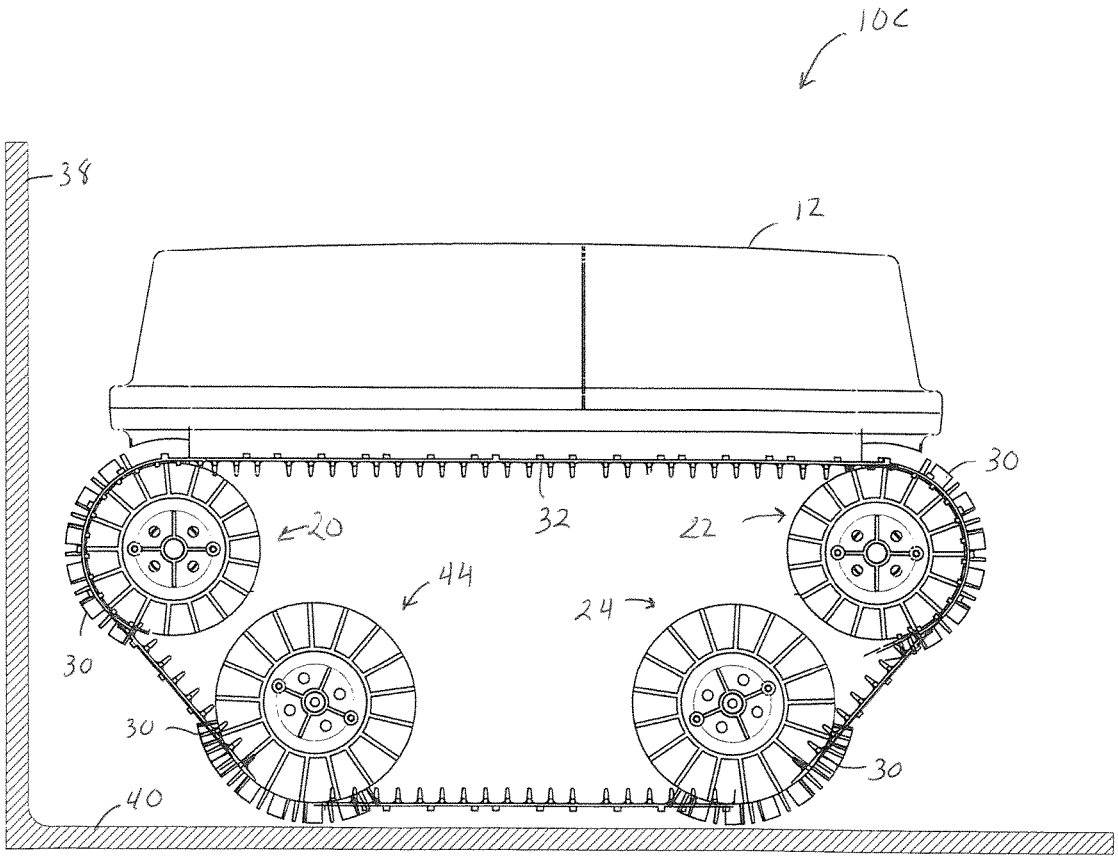
FIG. 13 is a side view of the swimming pool cleaning device approaching the side wall of a swimming pool in accordance with one aspect of the present application.
Figure 14:
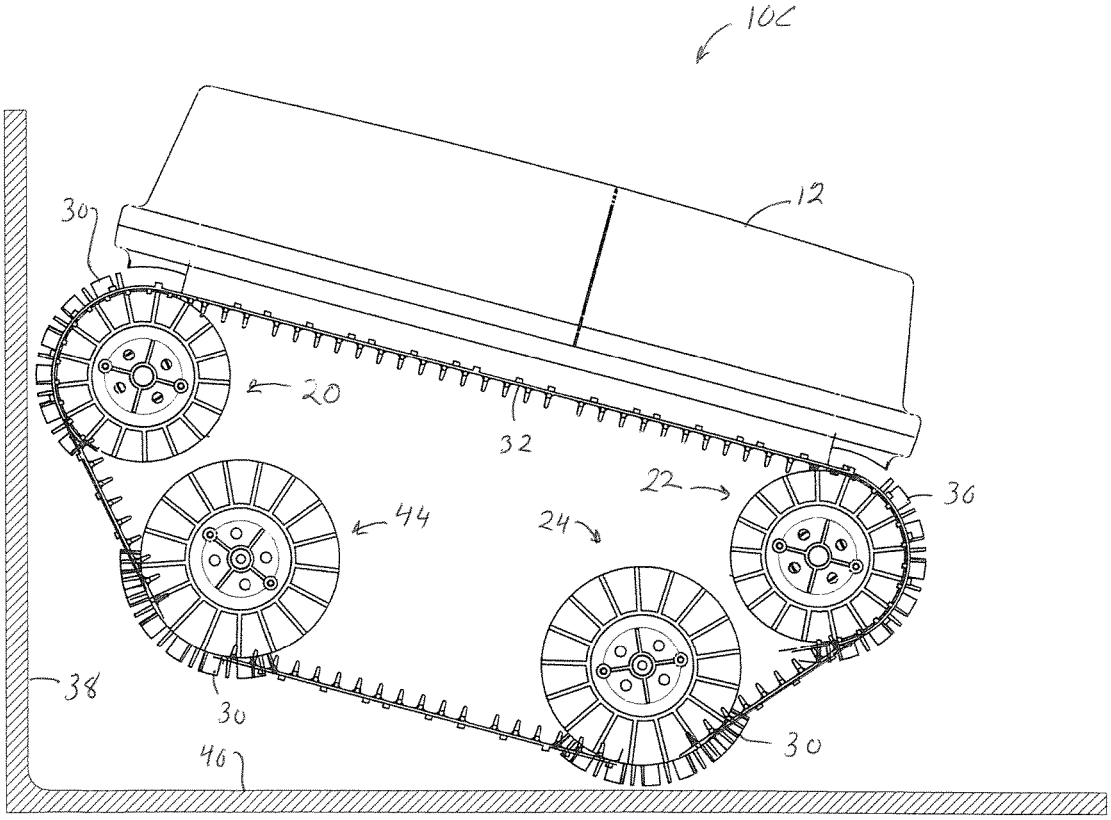
FIG. 14 is a side view of the swimming pool cleaning device of FIG. 13 engaging the side wall of a swimming pool in accordance with one aspect of the present application.
Figure 15:
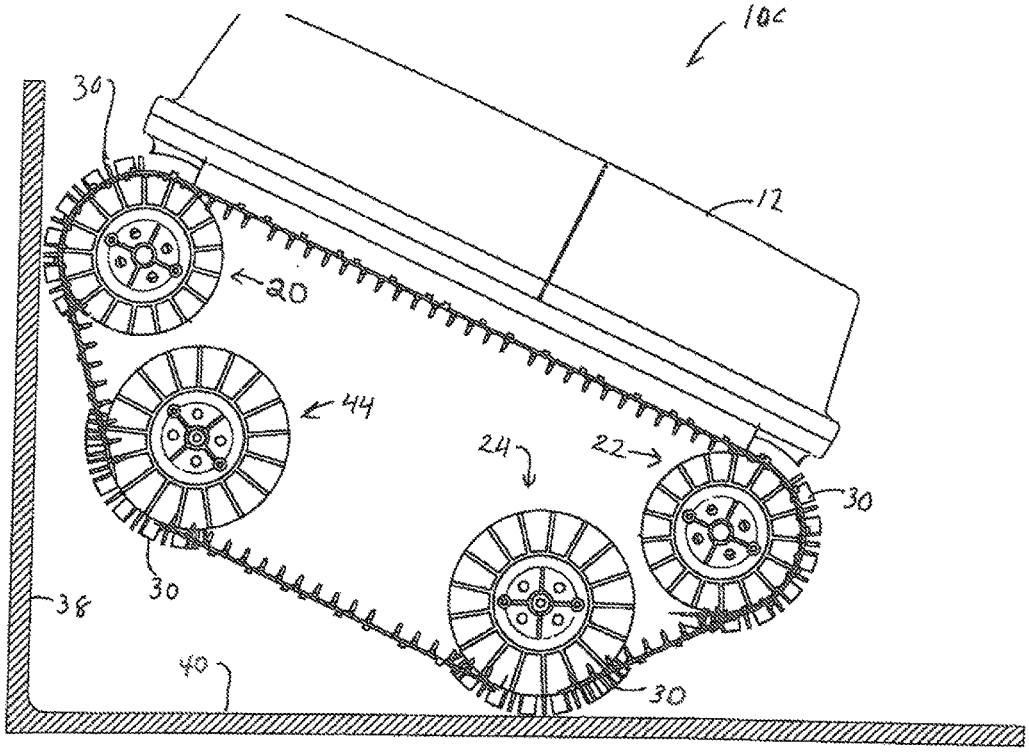
FIG. 15 is a side view of a swimming pool cleaning device of FIG. 13 climbing the side wall of a swimming pool in accordance with one aspect of the present application.

Referring to FIGS. 13-15, another embodiment of the pool cleaner 10C may be shown. The pool cleaner 10C has a first rolling mechanism 20, second rolling mechanism 22, third rolling mechanism 24 and a fourth rolling mechanism 44. The fourth rolling mechanism 44 may be formed of a pair of wheels 26, a roller 28, a combination of the pair of wheels 26 and the roller 28 or similar rolling devices. Brushing elements 30 may extend from an exterior surface of the roller 28 of the fourth rolling mechanism 44. A track 32 may be positioned around opposing ends of portions of the first rolling mechanism 20, second rolling mechanism 22, third rolling mechanism 24 and fourth rolling mechanism 44.

In the embodiment shown in FIGS. 13-15, the third rolling mechanism 24 and the fourth rolling mechanism 44 may be positioned between the first rolling mechanism 20 and the second rolling mechanism 22. In this embodiment, the first rolling mechanism 20 and second rolling mechanism 22 may be attached to the bottom area of the housing 12 on a first plane level. The third rolling mechanism 24 and the fourth rolling mechanism 44 may be attached to the bottom section of the housing 12 at a second plane level wherein the second plane level would be at a lower level than the first plane level. This may allow the third and fourth rolling mechanism 22 and 24 respectively to extend further down allowing the pool cleaner 10 to pivot about the third and fourth rolling mechanisms 24 and 44.

The pool cleaner 10C may move about the floor 40 of the swimming pool. The pool cleaner 10C may balance about the third and fourth rolling mechanisms 24 and 44. When the front section of the pool cleaner 10 engages the side wall 38, the pool cleaner 10 pivots about the third rolling mechanisms 24, lifting up and raising the front section of the pool cleaner 10C. This may allow the first rolling mechanism 20 to engage the side wall 38 while the third rolling mechanism 22 engages the floor 40 enhancing the climbing ability of the pool cleaner 10C. As the pool cleaner 10C climbs further up the side wall 38, the second rolling mechanism 22 may engage the floor 42 which may help to prevent the pool cleaner 10C from tipping over while the first and fourth rolling mechanisms 20 and 44 engage the side wall 38 which may enhance the climbing ability of the pool cleaner 10C.

Figure 16:
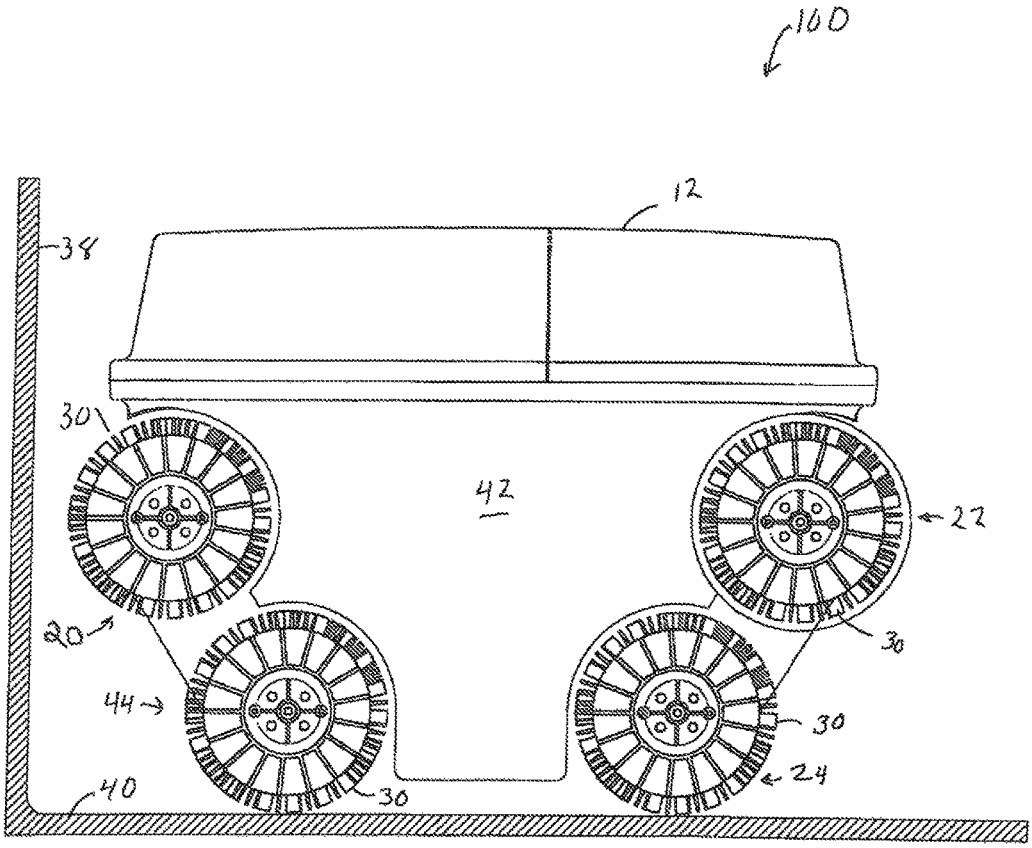
FIG. 16 is a side view of the swimming pool cleaning device of approaching the side wall of a swimming pool in accordance with one aspect of the present application.
Figure 17:
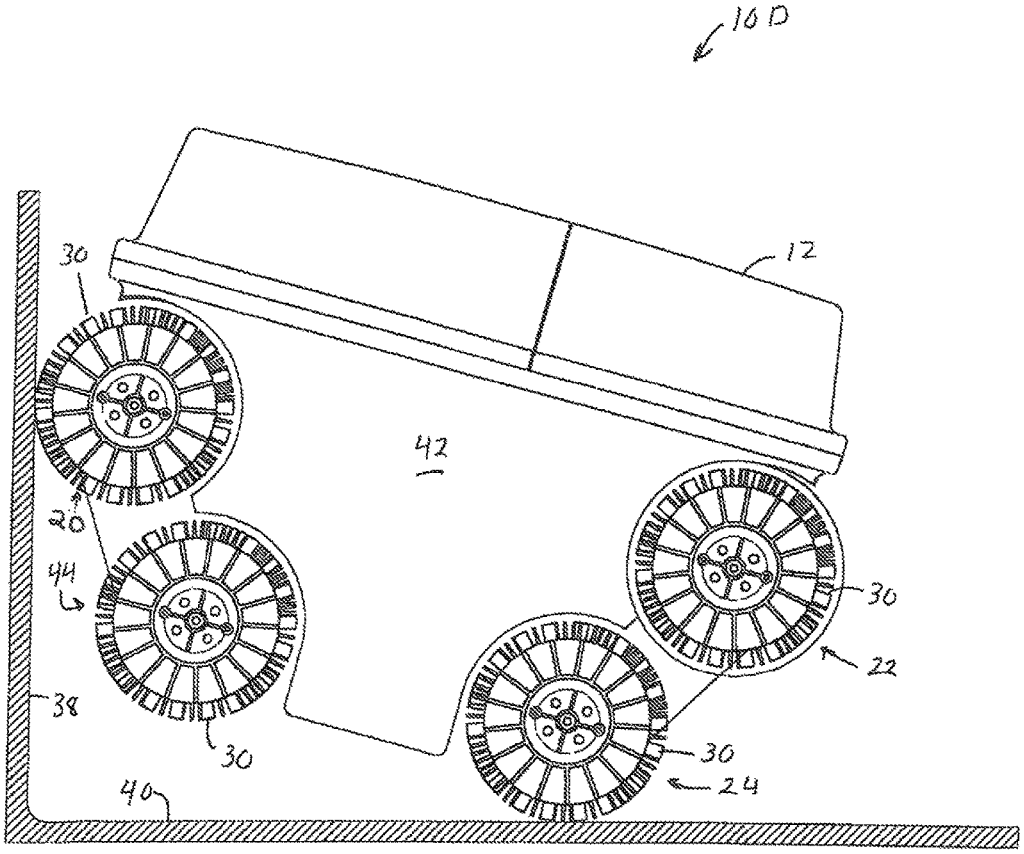
FIG. 17 is a side view of the swimming pool cleaning device of FIG. 16 engaging the side wall of a swimming pool in accordance with one aspect of the present application.
Figure 18:
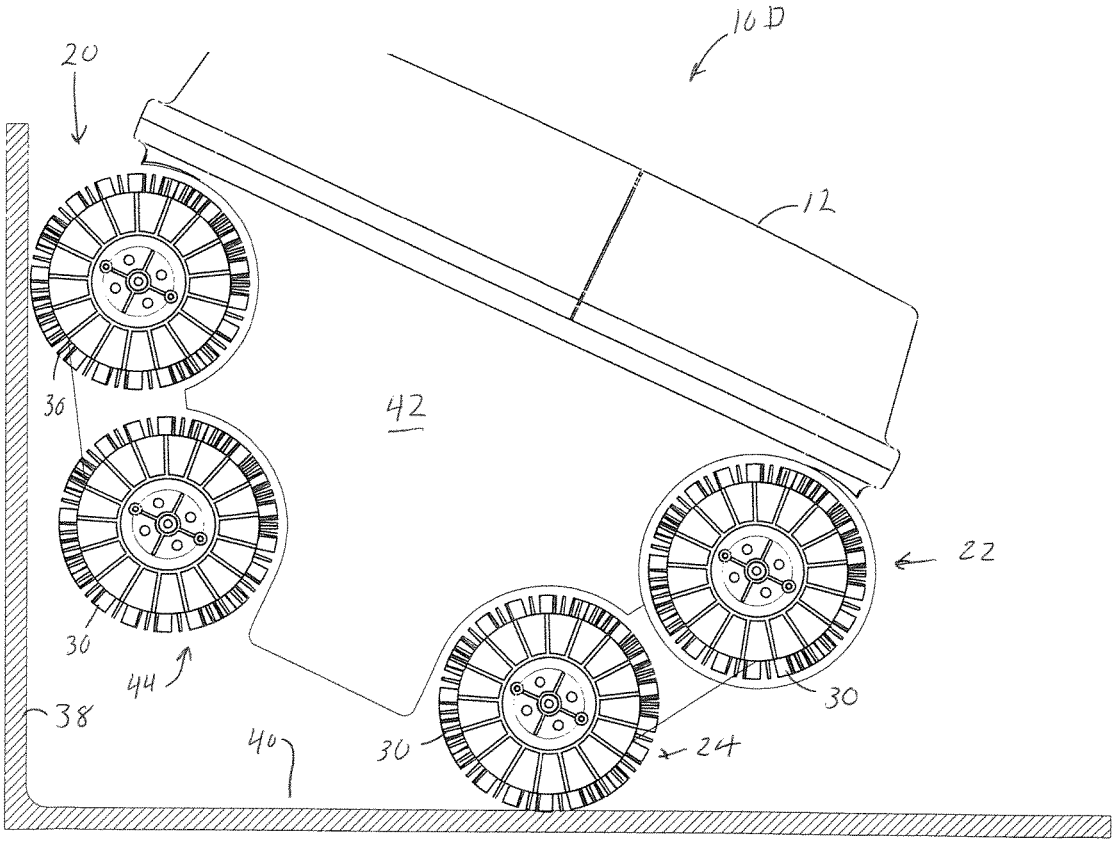
FIG. 18 is a side view of the swimming pool cleaning device of FIG. 16 climbing the side wall of a swimming pool in accordance with one aspect of the present application.

Referring to FIGS. 16-18, another embodiment of the pool cleaner 10D may be shown. The pool cleaner 10D has a plate member 42 extending down from the housing 12. The plate member 42 may be used to protect the first, second, third and fourth rolling mechanisms 20, 22, 24 and 44 respectively, as well as to provide stability by preventing the pool cleaner 10 from tipping over when engaging the side wall 38.

Figure 19:
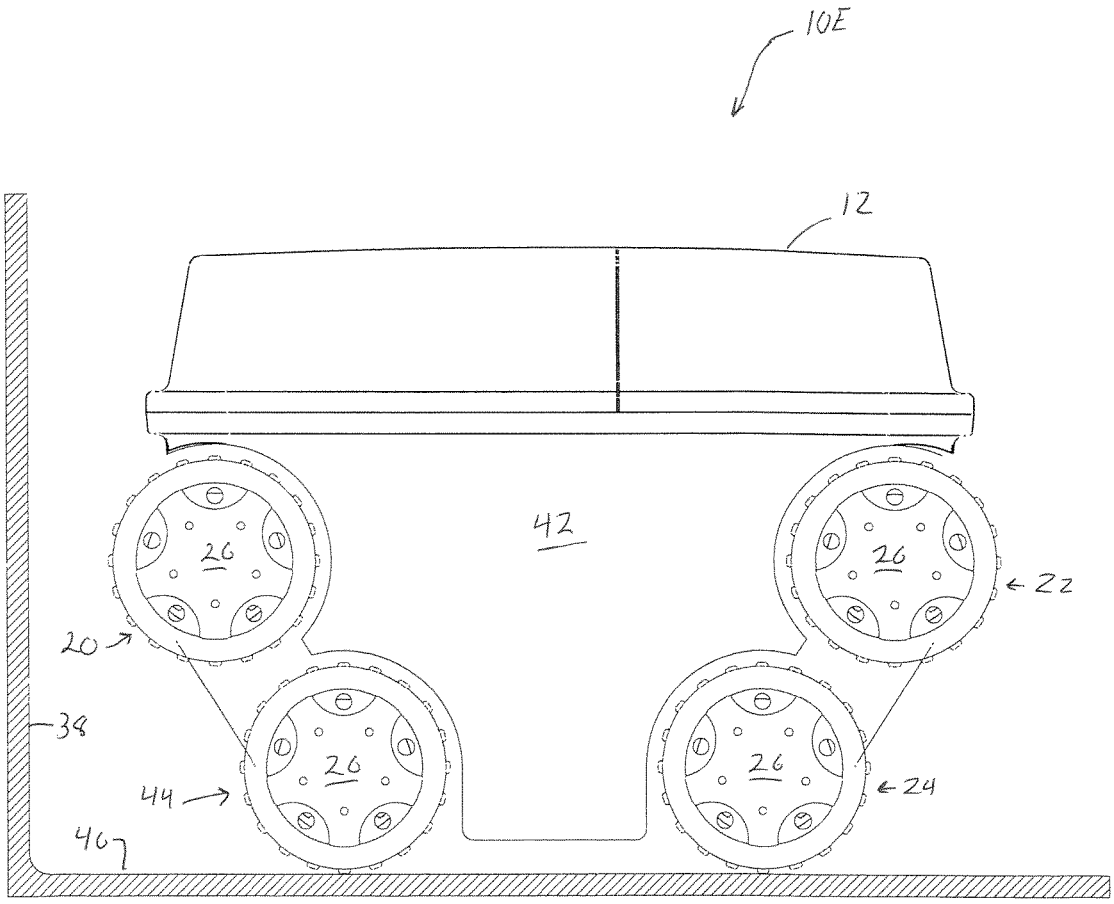
FIG. 19 is a side view of a swimming pool cleaning device approaching the side wall of a swimming pool in accordance with one aspect of the present application.
Figure 20:
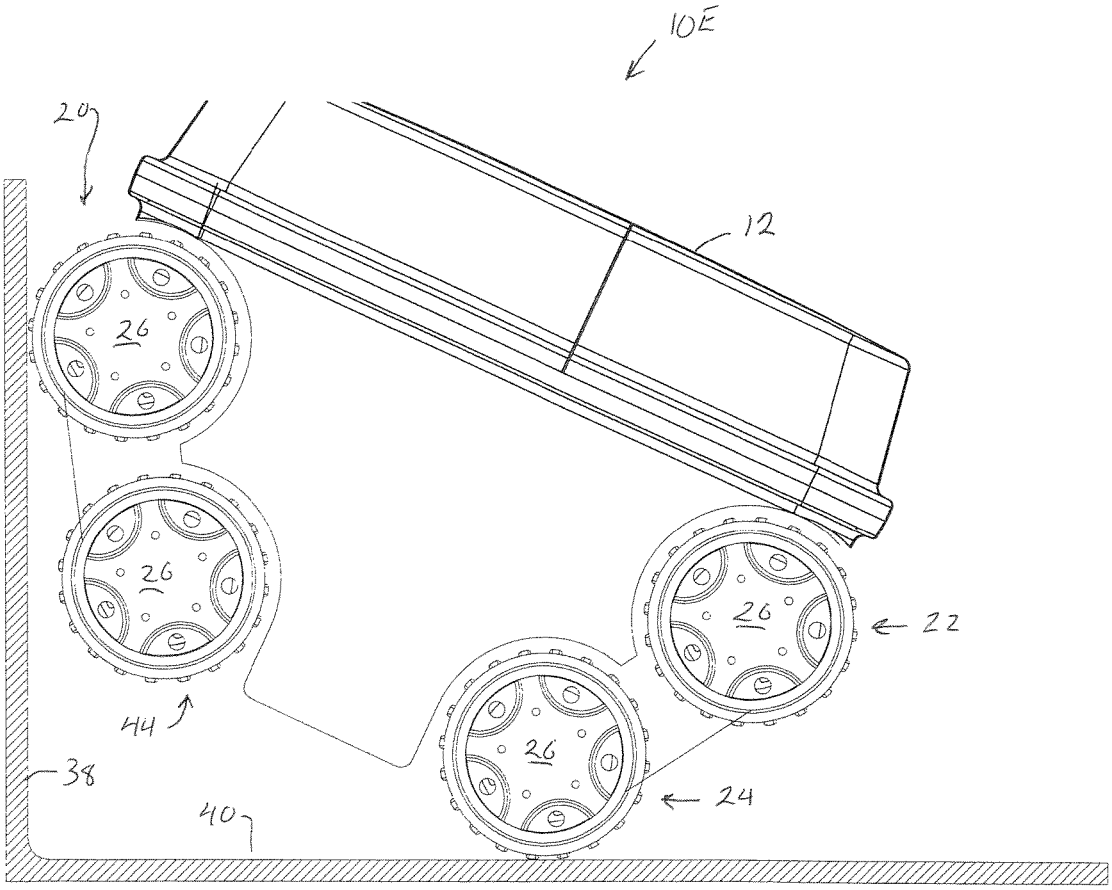
FIG. 20 is a side view of the swimming pool cleaning device of FIG. 19 climbing the side wall of a swimming pool in accordance with one aspect of the present application.

Referring to FIGS. 19-20, another embodiment of the pool cleaner 10E may be shown. The pool cleaner 10E has a plate member 42 extending down from the housing 12. The plate member 42 may be used to protect the first, second, third and fourth rolling mechanisms 20, 22, 24 and 44 respectively, as well as to provide stability by preventing the pool cleaner 10E from tipping over when engaging the side wall 38. In this embodiment, the first, second, third and fourth rolling mechanisms 20, 22, 24 and 44 do not have any brushing elements 30.

Figure 21:
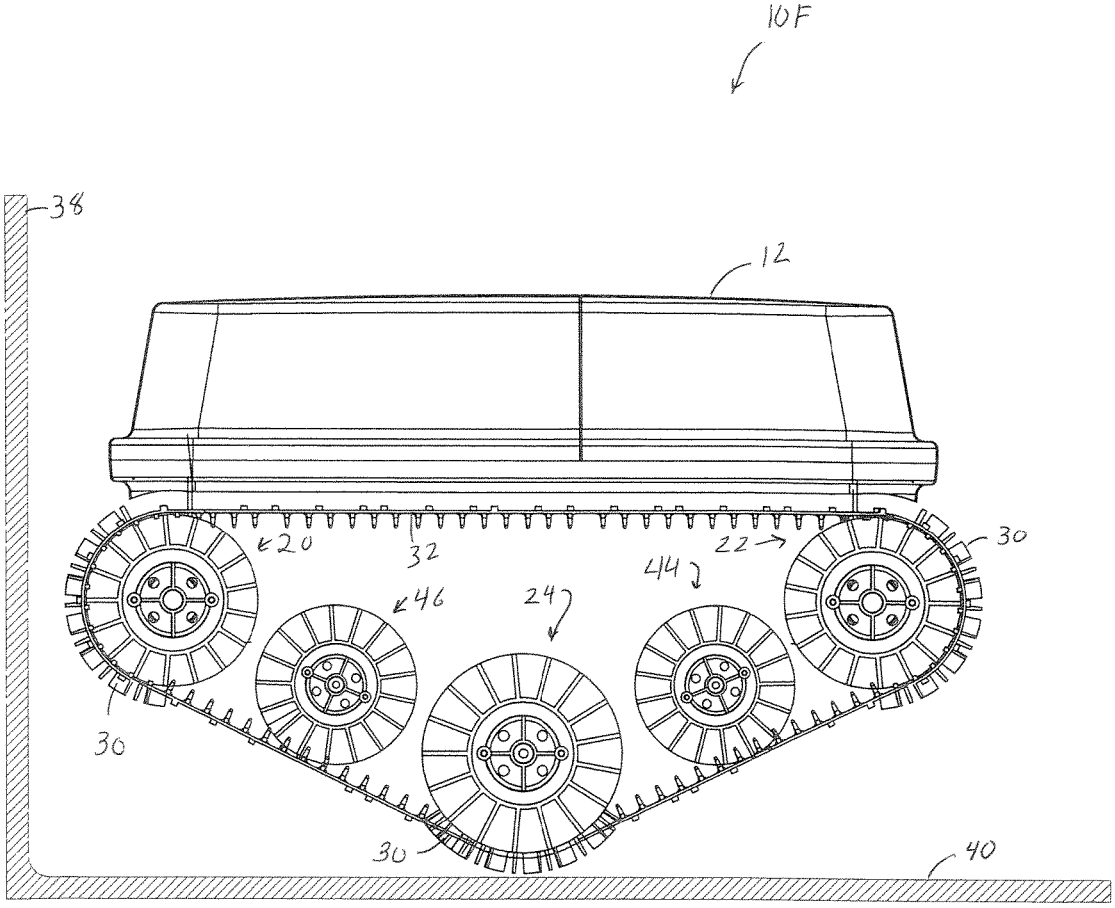
FIG. 21 is a side view of a swimming pool cleaning device approaching the side wall of a swimming pool in accordance with one aspect of the present application.
Figure 22:
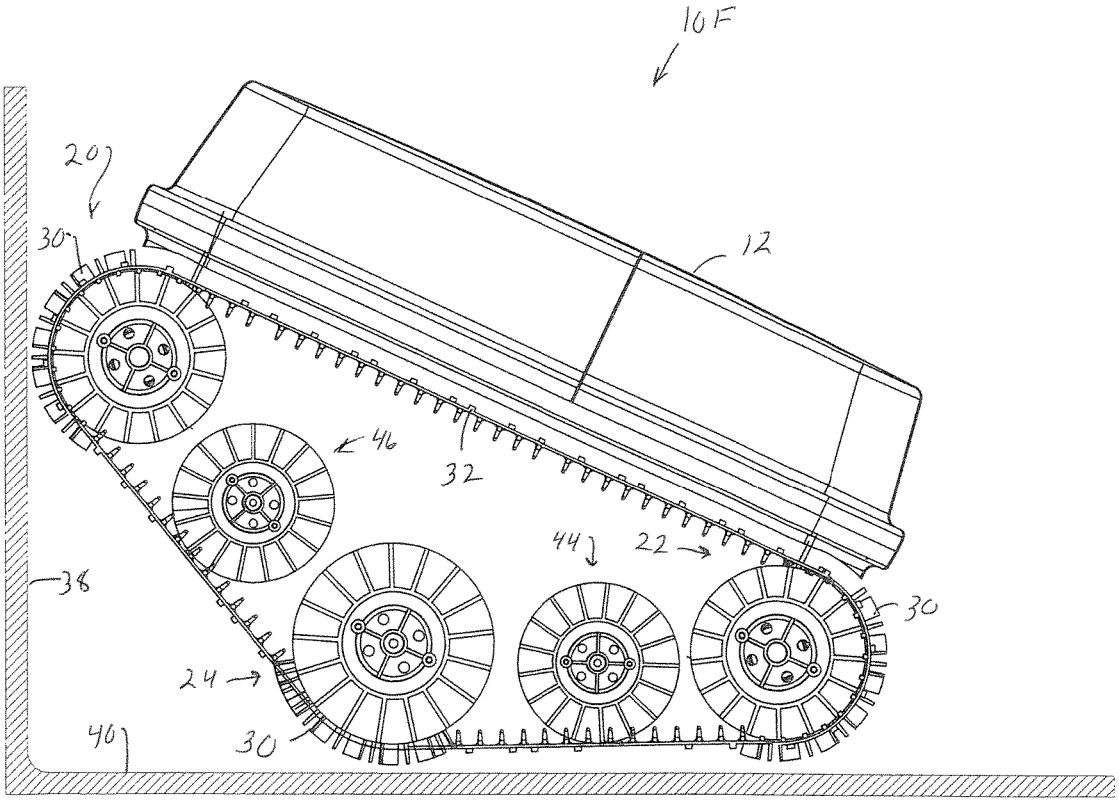
FIG. 22 is a side view of the swimming pool cleaning device of FIG. 21 climbing the side wall of a swimming pool in accordance with one aspect of the present application.

Referring to FIGS. 21-22, another embodiment of the pool cleaner 10E may be shown. The pool cleaner 10F has a first rolling mechanism 20, second rolling mechanism 22, third rolling mechanism 24, fourth rolling mechanism 44 and a fifth rolling mechanism 46. The fifth rolling mechanism 46 may be formed of a pair of wheels 26, a roller 28, a combination of the pair of wheels 26 and the roller 28 or similar rolling devices. A track 32 may be positioned around opposing ends of portions of the first rolling mechanism 20, second rolling mechanism 22, third rolling mechanism 24, fourth rolling mechanism 44 and fifth rolling mechanism 46.

In the embodiment shown in FIGS. 21-22, the fourth rolling mechanism 44 and the fifth rolling mechanism 46 may be positioned between the first rolling mechanism 20 and the second rolling mechanism 22. In this embodiment, the first rolling mechanism 20 and second rolling mechanism 22 may be attached to the bottom area of the housing 12 on a first plane level. The fourth rolling mechanism 44 and the fifth rolling mechanism 46 may be attached to the bottom section of the housing 12 at a second plane level wherein the second plane level would be at a lower level than the first plane level. The third rolling mechanism 24 may be positioned between the fourth rolling mechanism 44 and the fifth rolling mechanism 46. The third rolling mechanism 24 may be attached to the bottom section of the housing 12 at a third plane level wherein the third plane level would be at a lower level than the second plane level. This may allow the third 24 to extend further down allowing the pool cleaner 10F to pivot about the third rolling mechanisms 24.

The pool cleaner 10F may move about the floor 40 of the swimming pool. The pool cleaner 10F may balance about the third rolling mechanisms 24. When the front section of the pool cleaner 10F engages the side wall 38, the pool cleaner 10F pivots about the third rolling mechanisms 24, lifting up and raising the front section of the pool cleaner 10F. This may allow the first rolling mechanism 20 to engage the side wall 38 while the third rolling mechanism 22 engages the floor 40 enhancing the climbing ability of the pool cleaner 10F. As the pool cleaner 10F climbs further up the side wall 38, the second, third and fourth rolling mechanisms 22, 24 and 44 respectively may engage the floor 40 which may help to prevent the pool cleaner 10F from tipping over.

Figure 23:
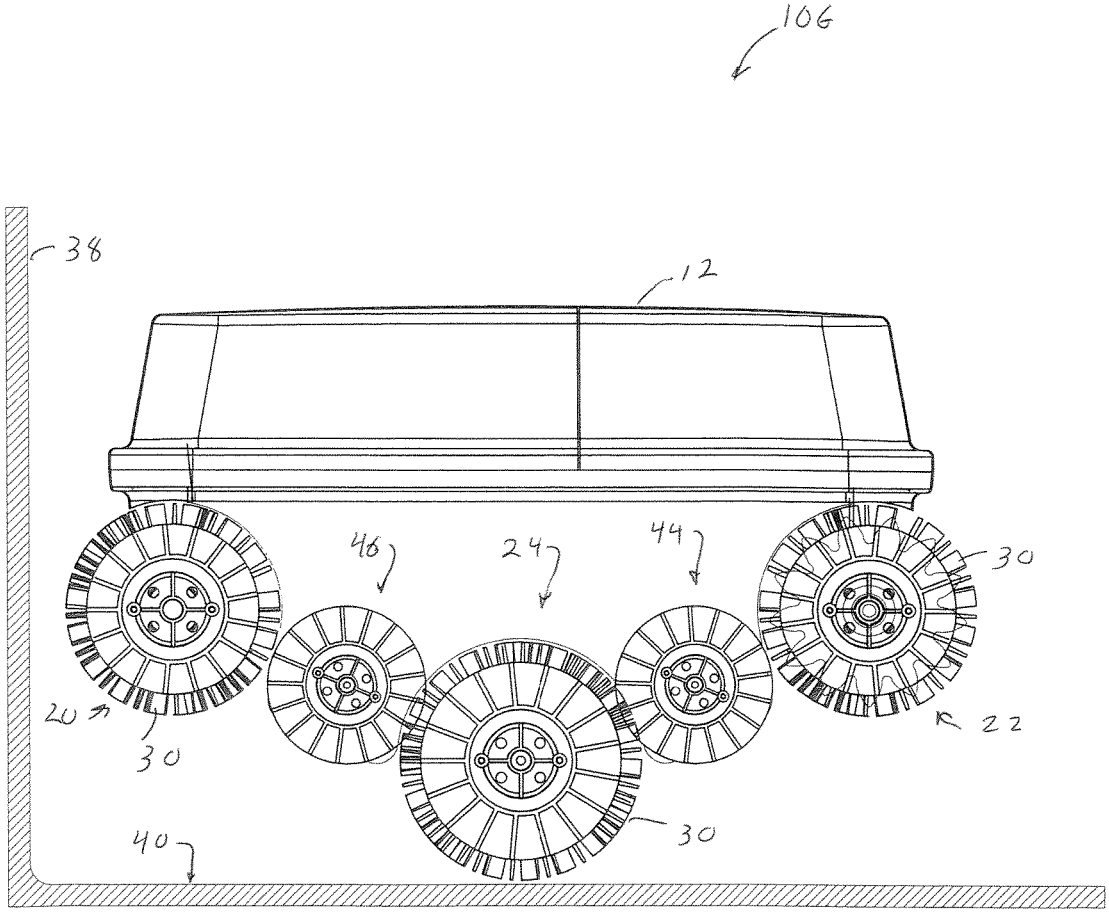
FIG. 23 is a side view of a swimming pool cleaning device approaching the side wall of a swimming pool in accordance with one aspect of the present application.
Figure 24:
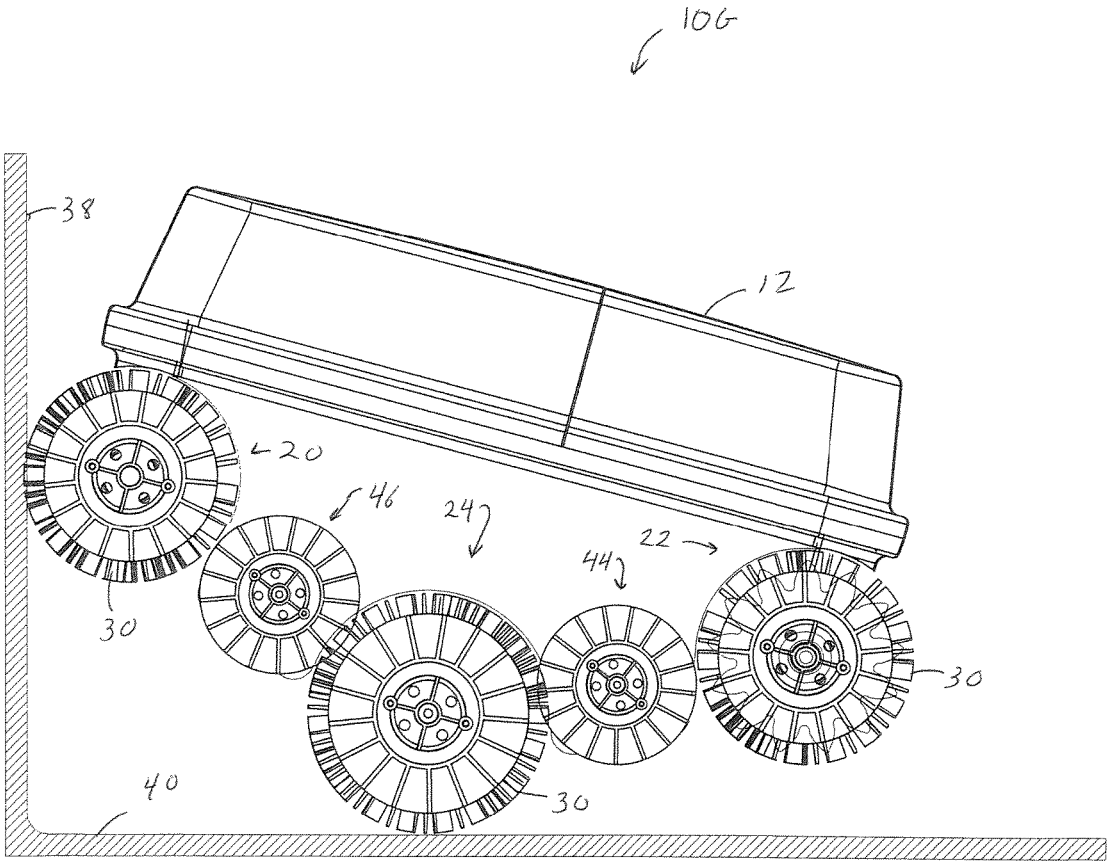
FIG. 24 is a side view of the swimming pool cleaning device of FIG. 23 climbing the side wall of a swimming pool in accordance with one aspect of the present application.

Referring to FIGS. 23-24, another embodiment of the pool cleaner 10G may be shown. The pool cleaner 10G has a first rolling mechanism 20, second rolling mechanism 22, third rolling mechanism 24, fourth rolling mechanism 44 and fifth rolling mechanism 46. In the present embodiment, no track is used around opposing ends of portions of the first rolling mechanism 20, second rolling mechanism 22, third rolling mechanism 24, fourth rolling mechanism 44 and fifth rolling mechanism 46.

Figure 25:
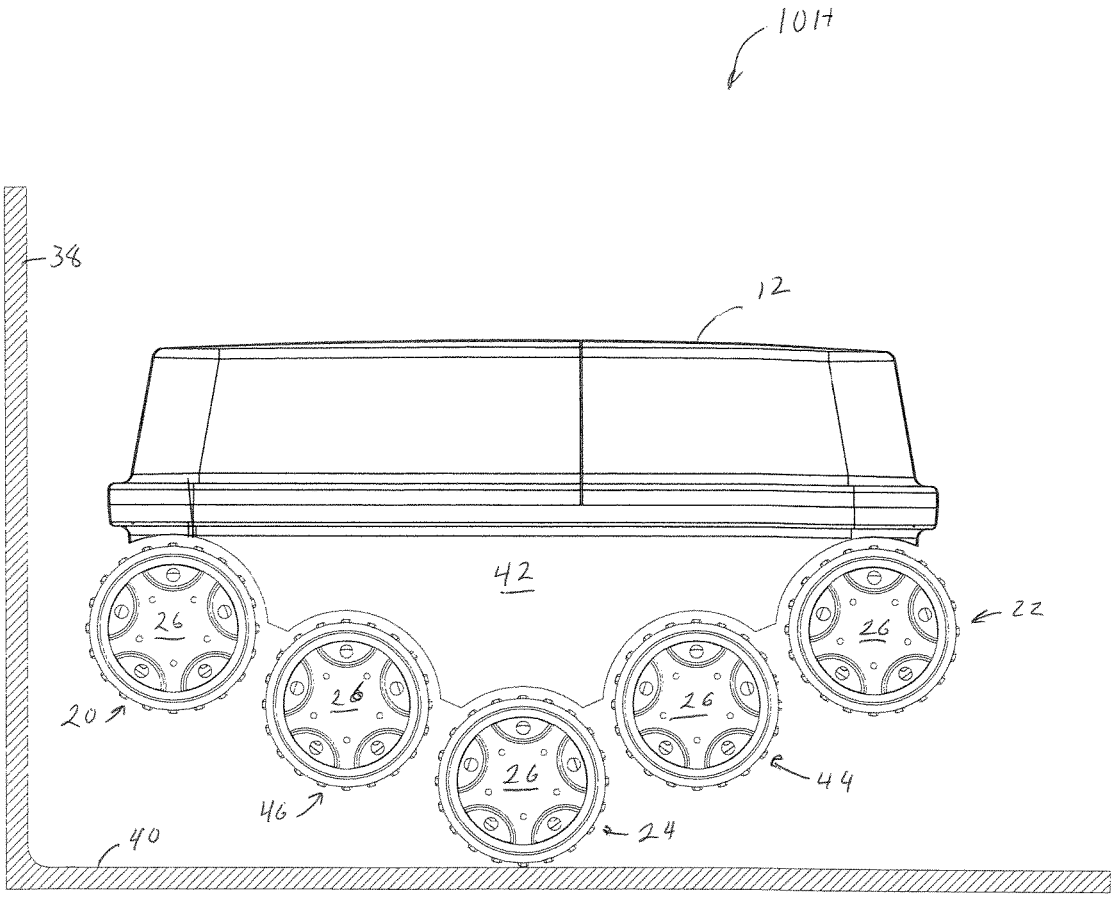
FIG. 25 is a side view of a swimming pool cleaning device approaching the side wall of a swimming pool in accordance with one aspect of the present application.
Figure 26:
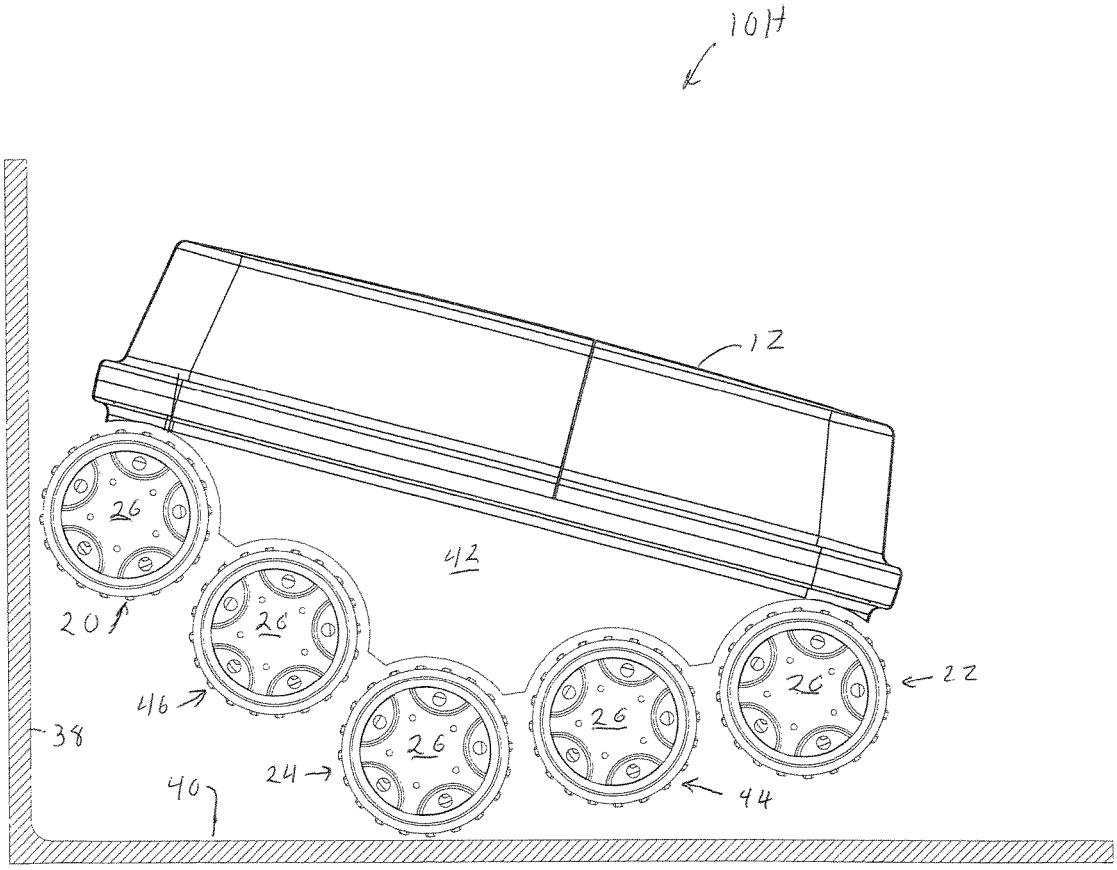
FIG. 26 is a side view of the swimming pool cleaning device of FIG. 25 climbing the side wall of a swimming pool in accordance with one aspect of the present application.

Referring to FIGS. 25-26, another embodiment of the pool cleaner 10H may be shown. The pool cleaner 10G has a first rolling mechanism 20, second rolling mechanism 22, third rolling mechanism 24, fourth rolling mechanism 44 and fifth rolling mechanism 46. In the present embodiment, the first rolling mechanism 20, second rolling mechanism 22, third rolling mechanism 24, fourth rolling mechanism 44 and fifth rolling mechanism 46 do not have a track or brushing elements.

The foregoing description is illustrative of particular embodiments of the application, but is not meant to be a limitation upon the practice thereof. The following claims, including all equivalents thereof, are intended to define the scope of the application.

What is claimed is:

1. An automated swimming pool cleaner comprising:

a housing having an inlet formed on a bottom surface thereof;

a drive mechanism located within the housing;

a first rolling mechanism coupled to a bottom section of the housing;

a second rolling mechanism coupled to the bottom section of the housing; and a single third rolling mechanism coupled to the bottom section of the housing in a center area of the housing between the first rolling mechanism and the second rolling mechanism, the single third rolling mechanism extending lower from the housing than the first rolling mechanism and the second rolling mechanism to allow the automated swimming pool cleaner to balance and move about a floor on the single third rolling mechanism, the automated swimming pool cleaner pivotable about the single third rolling mechanism in an up and down manner, the pivoting of the automated swimming pool cleaner about the single third rolling mechanism allowing the automated swimming pool cleaner to lift and raise a front section when the front section engages a wall allowing the first rolling mechanism to move up the wall while allowing the single third rolling mechanism to remain in contact with the floor;

a fourth rolling mechanism coupled to the bottom section of the housing; and a fifth rolling mechanism coupled to the bottom section of the housing;

wherein the first rolling mechanism and the second rolling mechanism are coupled to the bottom section of the housing at a first plane level, the fourth rolling mechanism and the fifth rolling mechanism are coupled to the bottom section of the housing at a second plane level, the second plane level being lower on the housing than the first plane level, and the third rolling mechanism is coupled to the bottom section of the housing at a third plane level, the third plane level being lower on the housing than the second plane level;

wherein the drive mechanism rotates at least one of the first rolling mechanism, the second rolling mechanism, or the third rolling mechanism.

2. The automated swimming pool cleaner in accordance with claim 1, further comprising a set of tracks coupled to the first rolling mechanism, the second rolling mechanism and the third rolling mechanism.

3. The automated swimming pool cleaner in accordance with claim 1, wherein the first rolling mechanism, the second rolling mechanism and the third rolling mechanism each comprises one of a wheel set, a roller or a combination of a wheel set and roller.

4. The automated swimming pool cleaner in accordance with claim 3, further comprising brushing elements extending from the roller.

5. The automated swimming pool cleaner in accordance with claim 1, further comprising a plate member extending down from the housing protecting the first rolling mechanism, the second rolling mechanism, the third rolling mechanism, the fourth rolling mechanism and the fifth rolling mechanism.

6. An automated swimming pool cleaner comprising:

a housing;

a pump located within the housing;

an inlet formed on a bottom surface of the housing for sucking up of dirt and debris into the housing through a vacuum created by the pump;

a first rolling mechanism coupled to a bottom front section of the housing;

a second rolling mechanism coupled to a bottom rear section of the housing;

a third rolling mechanism coupled to a bottom section of the housing between the first rolling mechanism and the second rolling mechanism, the third rolling mechanism extending lower from the housing than the first rolling mechanism and the second rolling mechanism allowing the automated swimming pool cleaner to balance and move about a floor of a pool on the single third rolling mechanism and to allow the automated swimming pool cleaner to pivot about the third rolling mechanism allowing the automated swimming pool cleaner to lift and raise a front section of the automated swimming pool cleaner when the front section engages a wall of the pool to allow the first rolling mechanism to move up the wall while allowing the third rolling mechanism to remain on the floor;

a fourth rolling mechanism coupled to the bottom section of the housing;

a fifth rolling mechanism coupled to the bottom section of the housing; and a drive mechanism located within the housing rotating at least one of the first rolling mechanism, the second rolling mechanism, or the third rolling mechanism;

wherein the first rolling mechanism and the second rolling mechanism are coupled to the bottom section of the housing at a first plane level, the fourth rolling mechanism and the fifth rolling mechanism are coupled to the bottom section of the housing at a second plane level, and the third rolling mechanism is coupled to the bottom section of the housing at a third plane level, the second plane level being lower on the housing than the first plane level and the third plane level being lower on the housing than the second plane level.

7. The automated swimming pool cleaner in accordance with claim 6, wherein the first rolling mechanism, the second rolling mechanism and the third rolling mechanism each comprises one of a wheel set, a roller or a combination of a wheel set and roller.

8. The automated swimming pool cleaner in accordance with claim 6, further comprising a plate member extending down from the housing protecting the first rolling mechanism, the second rolling mechanism, the third rolling mechanism, the fourth rolling mechanism and the fifth rolling mechanism.

* * * * *